United States Patent [19]

Baker et al.

[11] 4,380,271

[45] Apr. 19, 1983

[54] EARTH AUGER WITH REMOVABLE CUTTING TOOTH SUPPORT STRUCTURE

[75] Inventors: Donald R. Baker; Thomas R. Barr; Paul C. Smith, Jr., all of Denison, Tex.

[73] Assignee: Blue Streak Industries, Inc., Denison, Tex.

[21] Appl. No.: 255,129

[22] Filed: Apr. 17, 1981

[51] Int. Cl.[3] ..... E21B 10/44

[52] U.S. Cl. ..... 175/391; 175/394; 175/413

[58] Field of Search ..... 175/310, 385, 390, 391, 175/394, 392, 409, 410, 412, 413; 299/83, 87

[56] References Cited

U.S. PATENT DOCUMENTS

| | | | |
|---|---|---|---|
| 3,024,856 | 3/1962 | Henning | 175/394 |
| 3,106,973 | 10/1963 | Christensen | 175/410 |
| 3,235,018 | 2/1966 | Troeppl | 175/392 |
| 3,794,129 | 2/1974 | Taylor | 175/391 |

*Primary Examiner*—James A. Leppink
*Assistant Examiner*—Hoang C. Dang
*Attorney, Agent, or Firm*—W. J. Scherback

[57] ABSTRACT

An auger system is described having an upstanding axial stem with a pilot bit attached to the bottom of the stem. A downwardly spiraling flight structure affixed to the axial stem has a leading edge terminating in the vicinity of the pilot bit. Enhanced cutting operations are provided by way of a cutting tooth holder structure removably secured to the leading edge of the flight structure and extending from a position adjacent the stem above the pilot bit to a position proximate to the perimeter of the flight structure. The holder structure is provided with a plurality of spaced apart pockets for receiving shank portions of cutting teeth. Stresses applied to the cutting teeth during operations are distributed through the holder structure back to the flight structure by way of reinforcing webs which extend from a position proximate to each of the cutting tooth receiving pockets to a position for contact with the leading edge of the flight structure.

An improved rock cutting tooth is described having a principle cutting segment and a second segment which provides for reduced wear of the body of the tooth adjacent the first or principle cutting segment in order to reduce wear and thereby prevent the first cutting segment from breaking loose during cutting operation by reason of rapid erosion of the body portion.

6 Claims, 9 Drawing Figures

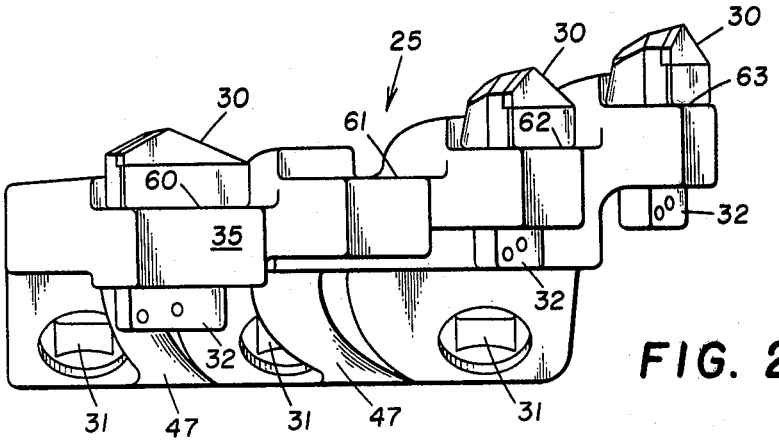
FIG. 2
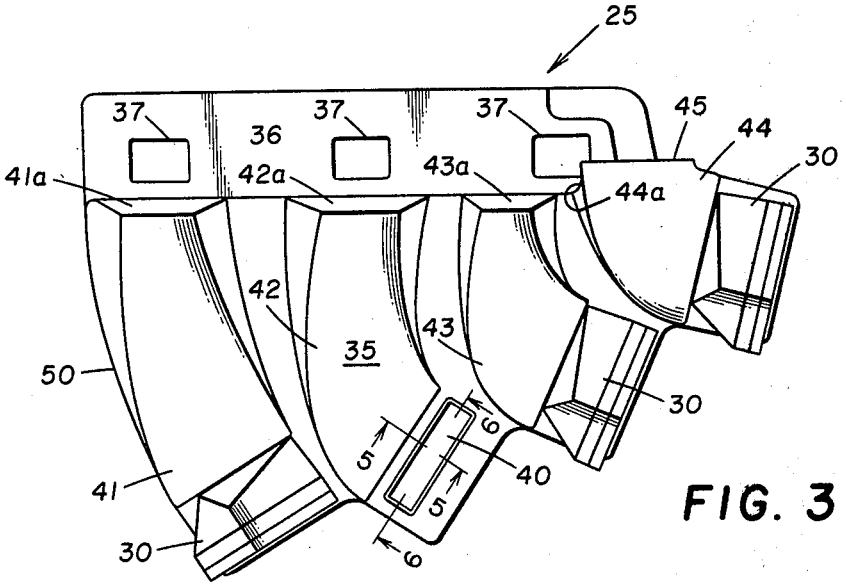
FIG. 3
FIG. 5
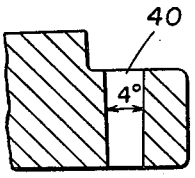
FIG. 6
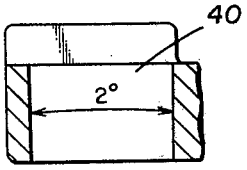

EARTH AUGER WITH REMOVABLE CUTTING TOOTH SUPPORT STRUCTURE

BACKGROUND OF THE INVENTION

1. Field of Invention

The present invention relates to earth augers and more particularly to the provision of an adapter plate for supporting cutting teeth disposed at the leading edge of the auger flight in order rapidly to adapt the auger for a most efficient operation under differing subsurface conditions.

2. The Prior Art

Earth augers for making hole in the earth whether it be unconsolidated or rock formations are well known as exemplified by U.S. Pat. No. 2,578,014. This patent describes an auger system having a central stem and a pair of helically shaped blades secured to the stem one on each side thereof and opposite one another. The blades form a double helix. Plates are secured to the leading edges of the blades with cutters radially spaced one from the other mounted to the plates.

U.S. Pat. No. 2,731,237 describes an earth auger having a plurality of peripherally spaced cutting bits mounted along the periphery of the lower portion of a flight in spaced relationship one from the other to cut annular zones of increasing diameter as the auger progresses into the earth.

The efficiency of making hole can be improved by arranging the cutting bits or teeth not only in step fashion as above described but also as shown in U.S. Pat. No. 3,794,129 in radial relationship one to the other so that an overlapping cutting action takes place. But this patent like the preceding patent provides for the mounting of the cutting teeth directly on the leading edge of the flight and thus the bit or tooth holders are a permanent part of the auger system.

SUMMARY OF THE INVENTION

The present invention provides an earth auger system with enhanced earth boring characteristics by introducing an adapter plate which in and of itself mounts and supports cutting teeth of new design enabling operators of earth augers to adapt existing systems of lesser cutting efficiency to take advantage of the features of the present invention.

The adapter plate includes a holder structure having means for removably securing the structure to a leading edge of the flight of an earth auger. The holding structure is dimensioned to extend substantially entirely across the leading edge of the flight. A plurality of spaced apart jackets receive shank or tang portions of cutting teeth. Reinforcing webs extend from a position proximate to each of the cutting tooth receiving pockets to a position for contact with a leading edge of the flight to provide a back support for each cutting tooth. One of the reinforcing webs has a portion to overlap with a bottom surface of the flight to guide the holder structure into position on the flight. The holder structure is further stepped on its lower surface at each pocket position, with each step having a height greater than the next step in direction toward the outer edge of the structure so that upon movement of the structure with an auger a series of concentric holes will be formed with the innermost hole being the deepest and the outermost hole being the most shallow.

Further in accordance with the present invention each tooth received in a pocket comprises a metallic body portion with a shank or tang extending upwardly from the body portion for insertion into a pocket with at least one hole in the upper portion of the shank for securing the tooth to the holder structure. The body portion of the tooth has a leading face relieved along an entire bottom and side portion to form an L-shaped recess. A first segment of metal harder than the body portion is secured in the recess along the entire bottom of the leading face. A second segment of metal also harder than the body portion is secured in the remaining portion of that recess. Those parts of the body portion immediately trailing the segments are relieved at an angle to reduce drag during cutting operations.

BRIEF DESCRIPTION OF THE DRAWINGS

In the accompanying drawings

FIG. 2 is a front elevation of the adapter plate;

FIG. 3 is a view of the bottom of an adapter plate of FIG. 2 with one of the cutting teeth removed to illustrate the shank receiving pocket;

FIG. 5 is a cross section taken through the pocket of FIG. 3 along line 5—5 showing the wedge shape of the pocket in one direction;

FIG. 6 is another cross section through the same pocket taken along line 6—6 showing the wedge shape in a second direction;

THE DETAILED DESCRIPTION

Figure 1:
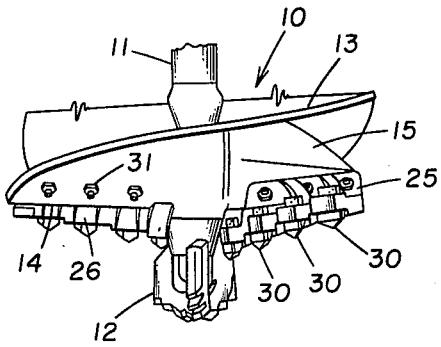
FIG. 1 illustrates an earth auger system embodying the present invention.

Referring now to FIG. 1 there is illustrated an auger system 10 including a central shaft or stem 11 at the lower end of which is secured a pilot bit 12. A flight or flighting 13 in the form of a helix is fixed to the stem to provide a leading edge 14. A dummy web or a flight 15 may be provided secured to the stem and similarly having a leading edge diametrically opposite from the leading edge 14 of the flighting 13. The provision of a dummy web 15 is optional with the operator but it does provide, by reason of a second leading edge, increased cutting efficiency.

Shown, in accordance with the present invention, secured to the leading edges of both the flighting 13 and the dummy web 15 are adapter plates 25 and 26 including holder structure for receiving and supporting a plurality of cutting teeth 30. The adapter plates 25 and 26 are each secured to their respective portions of the flighting and the dummy web by bolts 31—the flighting and the dummy web having previously been provided with bolt receiving holes matching those provided in the adapter plates. Inasmuch as the adapter plates 25 and 26 are identical in construction the description hereafter will concern itself solely with the details of adapter plate 25 with the understanding that the description will encompass the design and fabrication of the adapter plate 26.

It is well recognized that drilling conditions can vary from site to site and that to efficiently drill through materials of differing consistency, density and hardness will dictate auger cutting teeth of different design, spacing and arrangement relative to the flighting of an auger. The present invention avoids the necessity of carrying a number of different auger systems to a site. It makes possible on the other hand the use of one auger system to which selected adapter plates may be secured having the features of the present invention to provide for the most effective drilling at any given location.

As can be observed from FIG. 1 the cutting teeth 30 are arranged radially outward from the stem 11 and in stepped relationship one to the other. The cutting surfaces of the teeth 30 are arranged such that overlapping concentric cuts are made in the subsurface as the auger system is rotated. More particularly upon rotation of the auger system the pilot bit 12 makes the initial hole and thereafter upon continued movement of the auger a series of concentric holes are formed with the hole provided by the innermost cutting teeth being the deepest and the hole provided by the outermost cutting teeth being the most shallow. The cutting surfaces of the outermost teeth extend radially beyond the circumference of the dummy web 15 and the flighting 13 to produce a hole larger in diameter than the diameter of the flighting and thus avoid excessive wear upon the outer edge of the flighting as the auger system is rotated.

Figure 4:
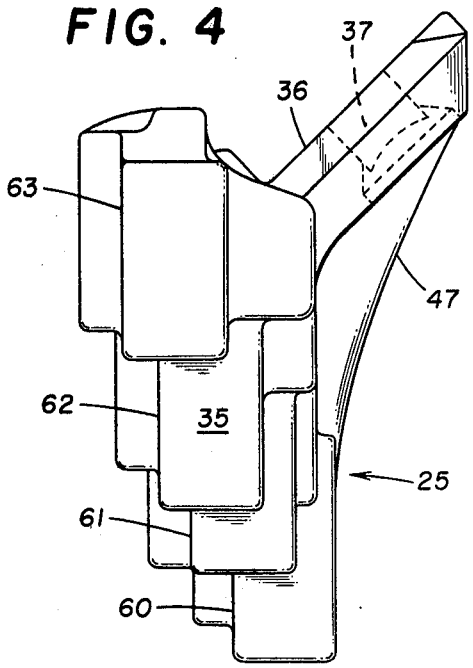
FIG. 4 is a side elevation of the adapter plates of FIG. 2 with the cutting teeth removed.

Referring now to FIGS. 2, 3 and 4, details of the adapter plate 25 are illustrated to include a holder structure 35 having a mounting surface 36 for engagement with a surface of either the flighting 13 or the dummy web 14. The mounting surface 36 is provided with a plurality of holes 37 (three are shown) which line up with corresponding holes provided in the flighting surface to receive therethrough suitable securing means such as bolts 31. When bolts 31 are employed the holes 37 in the holder structure 35 are recessed as shown in FIG. 2 so that the bolt heads lie beneath the upper surface of the holder structure in order to reduce wear and otherwise extend the life of the bolts 31.

The holder structure 35 is provided with a number of reinforcing webs 41, 42, 43 and 44 each of which extends from a position proximate to each of the cutting tooth receiving pockets 40 to a position toward the rear of the holder structure for contact with the leading edge of the flighting 13 or the dummy web 14. The leading edge of the flighting 13 or the dummy web 14 will engage back surfaces 41*a*, 42*a*, 43*a* and 44*a* respectively of reinforcing webs 41, 42, 43 and 44. The forward or front positions of the reinforcing webs 41–44 each will contact the back portion of the cutting teeth 30 and will therefore act to support the cutting teeth and distribute the forces or stresses encountered during the course of making hole.

It will also be noted that the reinforcing webs 41–44 are curved. More particularly, they are curved to approximate the arc of the concentric hole drilled by their respective cutting teeth. Thus in addition to providing for increased strength of the structure and in distributing stresses in forces in the auger system itself the curvature of the reinforcing webs reduces drag of the system during cutting operations.

The innermost web 44 has a portion which will overlap a surface of the flighting 13 opposite the surface engaged by the contact surface 36 of the holder structure to provide a guiding means to assist in mounting the holder structure to the leading edge of the flighting. In addition this extension spaced above the contact surface 36 may under certain circumstances provide a clamping action of the adapter plate to the flighting.

Additional strength is afforded the holder structure 35 by gussets 47 (FIG. 2) which also are curved to reduce drag during cutting operation.

As shown in FIG. 3 the cutting teeth 30 are sized to cut overlapping concentric holes during drilling operations and the outermost tooth 30 associated with reinforcing web 41 has a cutting surface wider than that of the inner cutting teeth so that the outer tooth extends beyond the outer dimension or outer surface 50 of the adapter plate 25 and therefore beyond the periphery of the flighting to which the adapter plate is secured. As aforesaid this enables the drilling of a hole of larger diameter than the diameter of the flighting to reduce wear of the flighting.

Shown best if FIGS. 2 and 4, the holder structure 35 is provided with stepped surfaces 60, 61, 62 and 63 which provide for staggered mounting of the cutting teeth 30 so that upon rotation of the auger system a series of concentric holes are formed with the innermost hole being the deepest and the outermost hole being the most shallow. Furthermore, each of the mounting pockets 40 is arranged so that when secured in place the cutting surfaces of the teeth 30 lie along the radii of the concentric holes to be cut by the teeth in order to provide for more efficient cutting operations.

As shown in FIGS. 5 and 6 each cutting tooth receiving pocket 40 is provided with a tapered slot which receives a complimentary tapered tang 32 of a cutting tooth 30 in a wedge-like manner. Once in position each cutting tooth can be secured there by use of a piece of bailing wire running through the holes in the tang or through the use of a carter pin (not shown).

Figure 9:
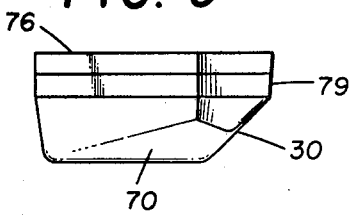
FIG. 9 is a bottom view of the cutting tooth of FIG. 7.
Figure 7:
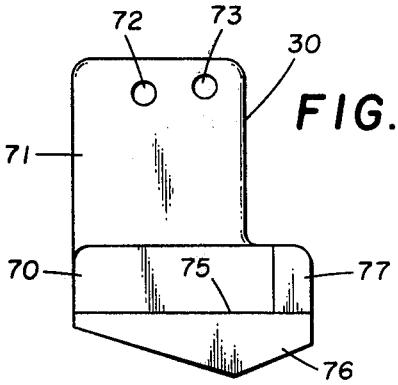
FIG. 7 is a front elevation of the cutting tooth of the present invention.
Figure 8:
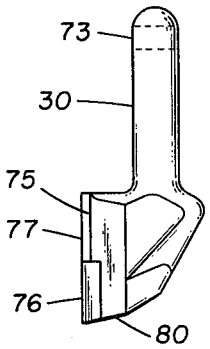
FIG. 8 is a side elevation of the cutting tooth of FIG. 7.

While the adapter plate of the present invention may be utilized in conjunction cutting teeth of different design, when drilling through rock it is preferred that cutting teeth of the type shown in FIGS. 7, 8 and 9 be utilized. While cutting teeth of the same general design have been itilized in the past as exemplified in FIG. 5 of U.S. Pat. No. 3,794,129 a significant improvement in cutting tooth life and therefore in more effective and more economical drilling is realized with the cutting tooth 30 of the present invention. The cutting tooth 30 includes a metallic body portion 70 with a shank or tang 71 extending upwardly from the body portion for insertion into the pocket of the holder structure 35. The tang 71 is provided with two holes 72 and 73 in the upper portion thereof for securing the tooth to the holder structure utilizing as aforesaid bailing wire or carter pins. The body portion 70 has a leading face which is relieved along the entire bottom and side portion to form an L-shaped recess 75. A first segment of metal 76 harder than the metal of the body portion 70 is secured in the recess along the entire bottom of the leading face. A second segment of metal 77 harder than the metal of the body portion 70 is secured in the remaining portion of the recess. The first segment 76 provides the principal cutting action of the tooth. Absent the second segment, the body 70 during cutting operations tends to wear excessively due to abrasive action. The result is that significant wear during cutting reduces the back support for the cutting segment 76 which soon breaks free rendering that particular tooth useless for further cutting of rock. The provision of the second segment significantly reduces wear of the body portion and thereby enhances the useful life of a cutting tooth.

In order to further increase drilling or cutting efficiency the body portion immediately trailing the cutting segments is relieved as at 79 and 80 to reduce drag.

It will be understood that while the invention has been described in conjunction principally with rock cutting teeth that teeth designed for drilling in dirt may be employed. Furthermore the attack angle of the teeth whether they be rock cutting teeth or dirt cutting teeth may be varied by providing a shim between the contact surface 36 of the holder structure and the surface of the flighting.

In one embodiment of the invention now in use the holder structure is cast in one piece utilizing an 81-30 alloy. The tooth 30 has a body and shank or tang portion formed of 41-30 alloy and the cutting segments 76 and 77 were formed of tungsten carbide.

Modifications will in view of the above description now become obvious to those skilled in the art and they are intended to be within the scope of the following claims.

What is claimed is:

1. An earth drilling tool for use with cutting teeth each having a shank portion and an enlarged body portion with cutting edges and integral with one end of the shank portion comprising:

an upstanding axial stem having a bottom pilot bit attached to the bottom of said stem, a downwardly spiraling flight structure affixed to said axial stem and having a leading edge terminating in the vicinity of said pilot bit, and cutting teeth holder structure removably secured to said leading edge of said flight structure and extending from a position adjacent said stem above said pilot bit to a position approximate to the perimeter of said flight structure, said holder structure having a plurality of spaced apart pockets extending through said structure for receiving shank portions of cutting teeth whereby the shank portions will pass through the pockets from one side of the structure to the other side, said holder structure including reinforcing webs having raised ends proximate to each of the cutting tooth receiving pockets for engagement with the body portion of the cutting teeth and extending to a position for contact with the leading edge of said flight structure to provide back supports for cutting teeth.

2. The tool of claim 1 in which there are provided a plurality of cutting teeth each mounted in its respective pocket, said pockets being arranged in said holder structure so that upon mounting of said holder structure to said flight structure said pockets are aligned along radial lines extending to the center of said stem and said reinforcing webs being curved to approximate the arc of the concentric hole drilled by their respective cutting teeth.

3. The tool of claim 1 in which one of said reinforcing webs having a portion which overlaps a bottom surface of said flight structure adjacent its leading edge to enhance the rigidity of coupling between said holder structure and said flight structure and to aid in mounting said holder structure to said flight structure.

4. The tool of claim 2 in which said teeth are sized direction normal to a cutting path such that each channel cut by one tooth overlaps an adjacent channel cut by an adjacent tooth.

5. The tool of claim 2 in which the lower portion of said holder structure has stepped surfaces with each surface receiving one of said cutting teeth an each surface having a height greater than the next surface in direction of the perimeter of said flight structure whereby upon rotation of the tool a series of concentric holes will be formed with the innermost hole being the deepest and the outermost hole being the most shallow.

6. An adapter for use with an earth auger for holding a plurality of cutting teeth in advance of the leading edge of a flight on the auger, the cutting teeth being of the type having a shank portion with an enlarged body portion having cutting edges and integral with one end of the shank portion:

a holder structure having means for removably securing said structure to a leading edge of the flight, and being dimensioned to extend substantially entirely across the leading edge of the flight, said holder structure having a plurality of spaced apart pockets extending through said structure for receiving shank portions of cutting teeth to pass through the pockets from one side of said structure to an opposite side of said structure, reinforcing webs on said holder structure having raised ends proximate to each of the cutting tooth receiving pockets for engagement with the body portion of the cutting teeth and extending to a position for contact with a leading edge of the flight to provide a back support for the body portion of each cutting tooth, one of said reinforcing webs having a portion for overlap with a bottom surface of the flight to guide said holder structure into position on the flight, and said holder structure being stepped in its lower surface at each pocket with each step having a height greater than the next step in direction toward the outer edge of said structure whereby upon movement of said structure with an auger a series of concentric holes will be formed with the innermost hole being the deepest and the outermost hole being the most shallow.

* * * * *